United States Patent [19]

Harris et al.

[11] 3,945,064

[45] Mar. 23, 1976

[54] ADJUSTABLE BED FRAME CONSTRUCTION

[75] Inventors: Allan E. Harris; George M. Harris, both of Chicago, Ill.

[73] Assignee: Harris-Hub Company, Inc., Harvey, Ill.

[22] Filed: Apr. 4, 1975

[21] Appl. No.: 564,987

[52] U.S. Cl. ..... 5/181; 5/184; 5/202; 248/408

[51] Int. Cl.[2] ..... A47C 19/00

[58] Field of Search ..... 5/181, 184, 185, 200, 201, 5/285; 248/353, 354 R, 354 P, 413; 403/107, 108

[56] References Cited

UNITED STATES PATENTS

| | | | |
|---|---|---|---|
| 1,501,931 | 7/1924 | Weddle | 403/107 |
| 1,793,035 | 2/1931 | Whitney | 248/354 |
| 3,744,068 | 7/1973 | Harris | 5/181 |

*Primary Examiner*—Casmir A. Nunberg
*Attorney, Agent, or Firm*—Dressler, Goldsmith, Clement & Gordon, Ltd.

[57] ABSTRACT

An improved adjustable cross frame member for use in a bed frame having side frame members and another such adjustable cross frame member. Each cross frame member comprises a pair of elongate elements including first and second perpendicular legs. One of the first legs has a plurality of longitudinally spaced position defining apertures corresponding to selectable positions of the cross frame member. The other of the first legs has a protrusion engageable with one of the apertures for retaining the elements against longitudinal movement in both directions when like legs of the elements are positioned in surface-to-surface adjacency. A locking means retains the elements against separation and includes a plurality of longitudinally spaced threaded openings in the first leg of the first element, each opening being associated with a corresponding aperture. A releasable locking member comprising a thumb screw is permanently mounted on the first leg of the second element and is engageable with the threads in one of the openings to retain the elements against separation.

4 Claims, 3 Drawing Figures

ADJUSTABLE BED FRAME CONSTRUCTION

BACKGROUND OF THE INVENTION

This invention relates generally to bed frames of the knock-down type and in particular to frame members comprised of two or more elements to be fastened together.

As is detailed in commonly assigned U.S. Pat. No. 3,646,623 to A. E. Harris and W. E. Behnke for "Bed Frame Assembly," U.S. Pat. No. 3,757,361 to G. M. Harris and W. E. Behnke for "Adjustable Bed Frame Member," U.S. Pat. No. 3,744,068 to A. E. Harris for "Adjustable Bed Frame Member," and U.S. Pat. No. 3,795,022 to G. M. Harris for "Adjustable Bed Rail Member Having a Locking Arm," a problem has long existed in the art because conventional bed frames of the above type have not provided positive interlocking engagement between cross frame members, and have required the use of a large number of fasteners, making it time-consuming to assemble and disassemble the bed frame assembly. Furthermore, with the advent of "king size" and "queen size" bedding, bed frame manufacturers have found it necessary to stock undesirably large inventories of bed frame assemblies of a given size, because of the complete lack of an easily manipulable and reliable means for adjusting the width of the bed frame assembly. The inventions of the above-referenced patents have solved such problems quite well, and have met with a very considerable degree of commercial success in so doing.

In order to further accommodate the quite evident demand for bed frames responsive to the above problems, it has also become desirable to furnish an adjustable bed frame member having the advantages of the above-referenced patents and which is even more conveniently and rapidly adjustable, and assembled and disassembled, and which at the same time has a lower cost and even more simplified construction.

SUMMARY OF THE INVENTION

Accordingly, bed frame members constructed in accordance with the present invention solve the problem encountered in the prior art by providing a secure but readily releasable interlocking relationship between bed frame elements which allows the bed frame to be quickly and easily assembled to one of a plurality of desired widths. The bed frame members of the present invention are useful as a side frame member as well as a cross frame member.

The improved adjustable bed frame member of the present invention is adapted to be fastened transversely between a pair of horizontally disposed further bed frame members so as to hold said further bed frame members in spaced parallel relationship. The improved member has first and second elongate elements. One of the elements is adapted at one end to be fastened to one of the pairs of further bed frame members and includes first and second generally perpendicular flat legs. The other element is adapted at one end to be fastened to the other of the pairs of further frame members and also includes first and second generally perpendicular flat legs. One of the first legs is provided with a plurality of longitudinally spaced apertures corresponding to selectable positions of the cross frame member while the other of the first legs is provided with an outwardly extending protrusion which is engageable with one of the apertures for retaining the elements against longitudinal movement in both directions relative to one another when like legs of the elements are positioned in surface-to-surface adjacency with respect to one another. Depending on which of the plurality of longitudinally spaced apertures is selected for cooperation with the detent, one or another of a plurality of possible positions of adjustment is chosen in order to give the overall member the desired length.

In order to complete the assembly of the respective first and second elements at the selected position of adjustment, the improved adjustable frame member further includes a cooperating locking means for retaining the first and second elements against separation. Such means includes a plurality of longitudinally spaced threaded openings in the first leg of the first elongate element, with one of the openings being associated with each of the selectable positions. The locking means also includes a releasable locking member comprising a screw means permanently mounted on the corresponding first leg of the second elongate element and engageable with the threads in one of the threaded openings for retaining the elements against separation.

The apertures and openings are preferably disposed on the same leg of the same element. The spacing between each threaded opening and its respective aperture is the same and, correspondingly, the screw means is spaced from the protrusion by a distance equal to the spacing between each threaded opening and its respective aperture.

In the preferred embodiment, the screw means is a thumb screw and has a manually graspable tab portion for effecting a turning movement so that upon the placement of the elongate elements in face-to-face adjacency with one another and the engagement of the protrusion with the aperture associated with the desired position of adjustment, the graspable portion is manipulable to turn the thumb screw and lock the elements in positively held together relationship in the selected position of adjustment. The bed frame member which is thereby formed is indefinitely held together in the desired adjustment and acts just as a continuous one-piece member. Yet upon manipulating the graspable tab portion to turn the screw in the opposite direction, the screw can be withdrawn from the opening and the elements can be separated to quickly and easily dissassemble or readjust the bed frame member to another desired length.

DETAILED DESCRIPTION OF THE PREFERRED EMBODIMENTS

Figure 1:
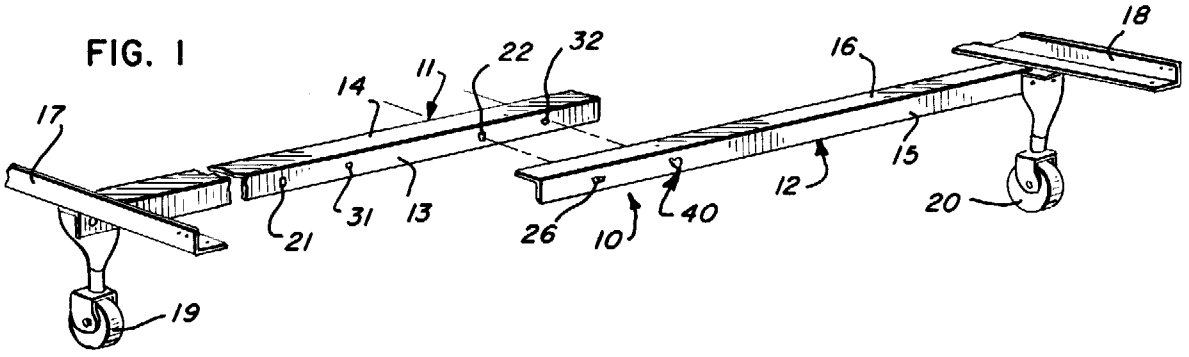
FIG. 1 is an exploded view, partially broken away, of the improved bed frame member of the present invention.

While this invention is susceptible of embodiment in many different forms, there is shown in the drawings and will herein be described in detail a preferred embodiment of the invention, with the understanding that the disclosure is to be considered as an exemplification of the principles of the invention and is not intended to limit the invention to the embodiment illustrated. The scope of the invention will be pointed out in the appended claims.

Referring now to the drawings, FIG. 1 shows the improved adjustable cross frame member 10, which is comprised of elongated elements 11 and 12 which are preferably L-shaped, but may also be C-shaped or other suitable shapes. Element 11 includes first and second generally perpendicular legs 13 and 14 of similar transverse widths; and element 12 includes first and second generally perpendicular legs 15 and 16 of similar transverse widths. Elements 11 and 12 are respectively fastened at one end to side frame members 17 and 18, and are positioned so that both leg portions 13 and 15 are vertically oriented and both leg portions 14 and 16 extend outwardly horizontally from the upper edges of legs 13 and 15, respectively. Side frame members 17 and 18 have legs with casters 19 and 20. As is well understood in the art, cross frame member 10 cooperates with an additional identically constructed cross frame member (not shown) spaced therefrom and parallel therewith to form a bed frame, in combination with side frame members 17 and 18. Elements 11 and 12 may be formed of commercially available cold rolled steel, and hence are relatively inexpensive.

In the illustrated usage, cross frame member 10 provides for a rapid and positive adjustment of the bed frame assembly to accommodate bedding of various sizes, as will be described below.

Element 11 is provided with a plurality of longitudinally spaced apertures 21, 22 lying along a common line in vertical leg 13 generally medially of the leg. Each aperture defines a selectable position of adjustment; thus, aperture 21 is the widest position of adjustment of member 10 and aperture 22 corresponds to a first medial position of adjustment corresponding to bedding of a smaller size. Though only two apertures are illustrated, additional apertures corresponding to the desired positions of adjustment are contemplated.

Figure 2:
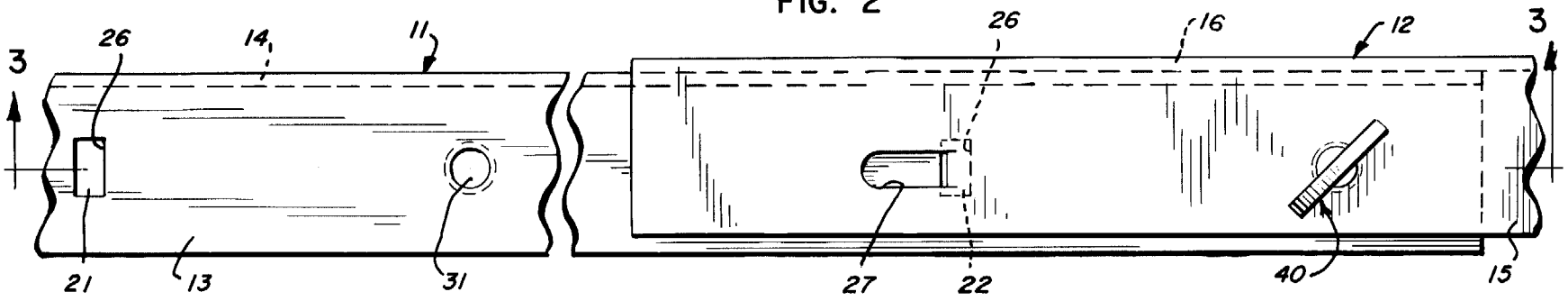
FIG. 2 is an enlarged fragmentary front elevational view of the improved member with its elements locked in a selected position of adjustment.
Figure 3:
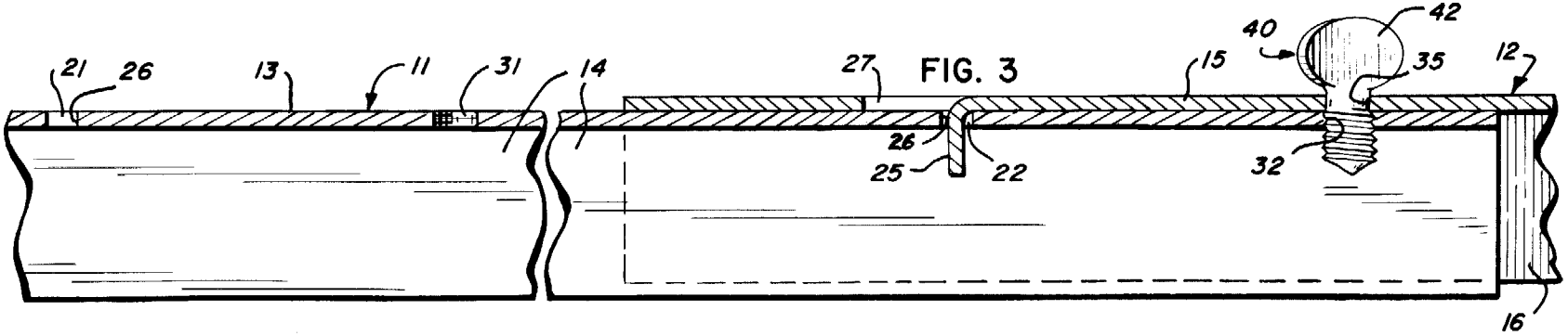
FIG. 3 is an enlarged fragmentary sectional view taken along plane 3—3 of FIG. 2.

Longitudinal movement between elements 11 and 12 is prevented in both directions by providing a detent means such as finger 25 (FIG. 3) which protrudes from leg 15 of element 12 and is engageable with one of the apertures 21, 22 provided in leg 13 of element 11. As shown in FIG. 3, finger 25 protrudes outwardly from leg 15 of element 12 and is insertable through one of apertures 21, 22 corresponding to the desired adjustment of the bed frame. When like legs of elements 11 and 12 are positioned in surface-to-surface adjacency with respect to one another, finger 25 engages the sidewall 26 of one of the apertures to retain elements 11 and 12 against longitudinal movement in both directions relative to one another. Leg 14 bears upon leg 16 and is supported thereon when elements 11 and 12 are assembled. As illustrated in FIGS. 2 and 3, apertures 21, 22 are generally rectangular and are preferably, but not necessarily, shaped to correspond to the configuration of finger 25, thereby limiting movement of finger 25 when inserted in a selected aperture.

To minimize the number of parts and the cost, it is preferable to have finger 25 integral with leg 15. One way of providing an integral finger 25 is by a stamping or punching method to bend a rectangular portion of leg 15 from the plane of leg 15, leaving slot 27 in leg 15.

A locking means is provided for retaining elements 11 and 12 against separation when a position has been selected and the elements are positioned in surface-to-surface adjacency with respect to one another. The locking means includes a plurality of longitudinally spaced openings 31, 32 in leg 13 which are associated with apertures 21, 22 and correspond to the selectable positions of bed frame member 10. As shown in FIGS. 2 and 3, openings 31, 32 are threaded to receive a screw. The spacing between each threaded opening and its respective aperture is the same.

Similarly, leg 15 of element 12 has a threaded opening 35 which is spaced from finger 25 a distance corresponding to the distance between aperture 21 and opening 31 in leg 13, and has a diameter equal to the diameter of openings 31, 32.

As best shown in FIGS. 2 and 3, the locking means further includes a releasable locking member comprising a screw means such as thumb screw 40 which is receivable in the opening 35 in leg 15 of element 12. Thumb screw 40 is permanently held in opening 35 in leg 15 by turning screw 40 until it has gone all of the way into threaded opening 35, and then further turning screw 40 until the thread in opening 35 and the thread on screw 40 are partially stripped, thereby preventing withdrawal of thumb screw 40 from leg 15. After the thread in leg 15 is stripped, thumb screw 40 can be freely turned while permanently held in opening 35, thereby enabling insertion of the thumb screw into one of the threaded openings 31, 32 in leg 13 with which thumb screw 40 is engageable for retaining elements 11 and 12 against separation. Thumb screw 40 has a manually graspable tab portion 42 which facilitates in turning the screw for insertion in leg 13 of element 11.

Although apertures 21, 22 and openings 31, 32 are illustrated as being in the same leg of the same element, it would also be possible to have the apertures and openings on corresponding legs of opposite elements, and even on opposite legs of the opposite elements.

Assembly of the elements 11 and 12 is a simple two-step operation which may be executed very rapidly. First, elements 11 and 12 are brought together so that like corresponding legs are in surface-to-surface adjacency. The particular aperture and corresponding opening in leg 13 which are selected for use with finger 25 and thumb screw 40 is determined by the length adjustment which is desired to be selected for the complete member 10, with one adjustment being that associated with aperture 21 and opening 31 and the longest adjustment being that associated with aperture 22 and opening 32. It will be appreciated that with the engagement of finger 25 within an aperture, relative longitudinal movement of elements 11 and 12 is prevented in both directions, although separation of the elements is still possible.

In order to preclude such separation and thus fully lock elements 11 and 12 in positively held together relationship in the selected position of adjustment, thumb screw 40 is manually grasped and turned until elements 11 and 12 are tightly held together.

Once a position of adjustment is selected and finger 25 and thumb screw 40 are inserted through an aperture and opening in leg 13 and the thumb screw is turned, the legs of the respective elements cannot separate and cannot move transversely or longitudinally with respect to one another.

In addition to retaining elements 11 and 12 together, thumb screw 40 and finger 25 provide spaced bearing points for load distribution once the bed frame has been assembled, and a box spring and mattress (and/or user) bears thereon. The result is a rigid cross rail member 10 having a selected one of a plurality of available lengths whose rigidity and adjustment is maintained indefinitely yet which is instantly modifiable or dissassembled by turning thumb screw 40 in the opposite direction to withdraw thumb screw 40 from engagement with the threads in the selected opening in leg 13. Elements 11 and 12 can then be separated, whereupon a new adjustment may be selected, if desired.

We claim:

1. A bed frame member adapted to extend transversely between a pair of further bed frame members positioned in spaced parallel relationship, and be retained in one of a plurality of selected positions, comprising: a first elongated element having first means adjacent one end for fastening said first element to one of said further bed frame members, said first element including first and second generally perpendicular flat legs; a second elongated element having second means adjacent one end for fastening said second element to the other of said pair or further bed frame members and including first and second generally perpendicular flat legs; a plurality of longitudinally spaced apertures in one of said first legs, each aperture corresponding to one of said selectable positions; a protrusion on the other of said first legs and engageable within one of said apertures for retaining said elements against longitudinal movement in both directions relative to one another when like legs of said first and second elements are positioned in surface-to-surface adjacency with respect to one another; and cooperating locking means for retaining said elements against separation when a position has been selected and the legs of said elements are positioned in surface-to-surface adjacency with respect to one another, said locking means including a plurality of longitudinally spaced threaded openings in said first leg of said first element, each opening being associated with one of said apertures and corresponding to one of said selectable positions, the spacing between each threaded opening and its respective aperture being the same, a threaded opening in the first leg of said second element and having the same diameter as the threaded openings in said first leg of said first element, the thread in said opening in said first leg of said second element being partially stripped, and a releasable locking member comprising a screw means having a partially stripped thread received in said opening in said first leg of said second element to permanently mount said screw means on said second element, said screw means being engageable with the threads in one of said openings in said first leg of said first element for retaining said first and second elements against separation, and said screw means being spaced from said protrusion by a distance equal to the spacing between each threaded opening and its respective aperture.

2. A bed frame member as defined in claim 1 wherein said screw means comprises a thumb screw having a manually graspable tab portion.

3. A bed frame member as defined in claim 1 wherein said apertures and said openings are on the same leg of the same element.

4. A bed frame member as defined in claim 1 wherein said protrusion is integral with the other of said first legs.

* * * * *